United States Patent [19]

Curtis

[11] Patent Number: 4,515,240

[45] Date of Patent: May 7, 1985

[54] PERSONAL SAFETY DEVICE

[76] Inventor: John Curtis, 79 Baker Ave., Dover, N.J. 07801

[21] Appl. No.: 465,908

[22] Filed: Feb. 14, 1983

[51] Int. Cl.[3] ..... A62B 1/14; A62B 1/20

[52] U.S. Cl. ..... 182/6; 188/65.5

[58] Field of Search ..... 182/5, 6, 7, 8, 191, 182/193; 188/65.4, 65.5

[56] References Cited

U.S. PATENT DOCUMENTS

| | | | |
|---|---|---|---|
| 284,763 | 9/1883 | Scholl | 182/7 |
| 306,078 | 10/1884 | Hubner | 182/7 |
| 544,724 | 8/1895 | Cotton et al. | 188/65.5 |
| 559,443 | 5/1896 | Duhy | 188/65.5 |
| 1,169,760 | 2/1916 | Barrett | 182/6 |

FOREIGN PATENT DOCUMENTS

| | | | |
|---|---|---|---|
| 100822 | 7/1916 | United Kingdom | 182/5 |

*Primary Examiner*—Reinaldo P. Machado
*Attorney, Agent, or Firm*—Thomas Adams

[57] ABSTRACT

A safety device allows controlled descent along a suspended rope. The safety device includes a base that rides the suspended rope. There is a manually operable apparatus mounted on the base which is used for adjustably gripping the rope. At least one handlebar is mounted transversely to the base, available for grasping by the escapee. In addition, a stirrup may be suspended from the base to provide further support for the descending escapee.

8 Claims, 5 Drawing Figures

PERSONAL SAFETY DEVICE

BACKGROUND OF THE INVENTION

The present invention relates to personal safety equipment and, in particular, to devices used to lower persons from the upper stories of a building.

A conventional form of safety equipment for guarding against the risk of falling from considerable height comprises a safety line gripped by the person and attached at its upper end to a fixed anchorage. This equipment may be buckled through a belt to control descent but the escapee must be physically capable of controlling the descent. However, this often is not the situation since a person may suffer rope burns.

Another form of such safety equipment in common use is the rope ladder. The ladder device may be suspended from a window sill by associated hooks or otherwise. While the foregoing enables the individual to escape safely, a disadvantage is the large amount of space required to store a rope ladder. Furthermore, the escapee may not be physically capable or sufficiently coordinated to climb a rope ladder.

Accordingly, there is a need for a simple and effective personal safety device which avoids the disadvantages of the prior art.

SUMMARY OF THE INVENTION

In accordance with the illustrative embodiments demonstrating features and advantages of the present invention, there is provided a safety device for allowing controlled descent down a rope. The safety device comprises a base and a manually operable means mounted on this base for adjustably gripping the rope. At least one transverse handlebar is mounted on the base. Also, a stirrup is suspended from the base.

By employing the foregoing apparatus, descent along a rope can be easily controlled. Persons needing to exit a burning structure, for example, can use this device to escape safely through a window. The descent may be controlled by the escapee during descent or preset by an assistant in the room where the end of the rope is attached to a fixed anchorage.

Since it is possible to set the manually operable means prior to descent, an infant or disabled person could be lowered in a harness suspended from the base, or a disabled person strapped into a harness suspended from the base could descend safely.

In a preferred embodiment of the invention, the handlebar has a threaded bore, and the manually operable means comprises a rod threaded into the bore of the handlebar. There is also, preferably, a backstop mounted on the base which is perpendicular to the threaded rod. The rod is turnable to adjustably squeeze the rope against the backstop.

The manually operable means may also employ a handle rotatably mounted on the base. The handle has an inner camming end. By rotating the handle, its camming end can also adjustably squeeze the rope against said backstop. The base, preferably, has at least one aperture for routing the rope through the base past the backstop. The rope path also passes through a pair of arched guides mounted on the base for guiding the rope through the backstop. The resulting serpentine rope path increases drag on the rope making the descent more readily controllable.

Thus, the present safety device is a compact unit only requiring a single safety line. This easily stored package can be quickly installed in an emergency to allow safe descent from almost any height. The device can service subsequent escapees by the simple expedient of hauling the device up and switching the free and anchored ends. The foregoing can be performed reliably and inexpensively.

BRIEF DESCRIPTION OF THE DRAWINGS

The above description, as well as other objects, features, and advantages of the present invention, will be more fully appreciated by reference to the following detailed description, and accompanying drawings, of the presently preferred (but, nonetheless, illustrative) embodiment of the present invention. Within the drawings.

DETAILED DESCRIPTION OF THE PREFERRED EMBODIMENT

Figure 1:
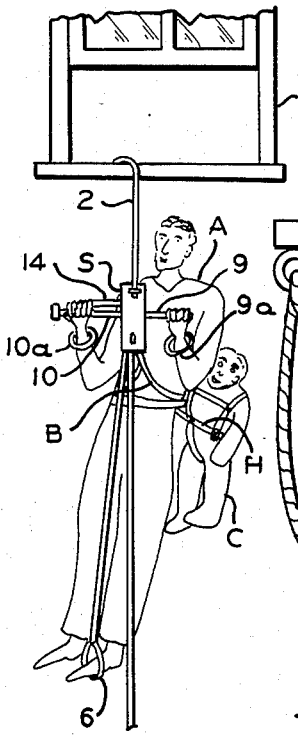
FIG. 1 is an illustration of a person using this personal safety device.

Referring to FIG. 1, person A is illustrated using personal safety device S. Rope 2 is shown suspended from the outside of window W. The upper end of rope 2 is attached to a fixed anchorage (not shown) such as a bed leg in the room, the lower end of rope 2 lying on the ground. Rope 2 is threaded through safety device S in a manner to be described presently.

Person A is holding both the right and the left handlebars 10 and 9, and his left foot is in stirrup 6 as he descends. As further described hereinafter, stirrup 6 can be a rope suspended from device S and having a loop formed in its lower end. A pair of wrist loops 9*a* and 10*a* are shown suspended from the ends of handlebars 9 and 10, respectively. Person A is shown wearing loops 9*a* and 10*a* as a precaution against losing his grip on handlebars 9 and 10.

Also suspended from safety device S is safety belt B, shown encircling the waist of person A. Harness H is shown holding child C. Harness H is a conventional child's harness having a waist, shoulder and crotch strap for securely holding infant C. Belt B connects to the waist band of harness H.

Figure 2:
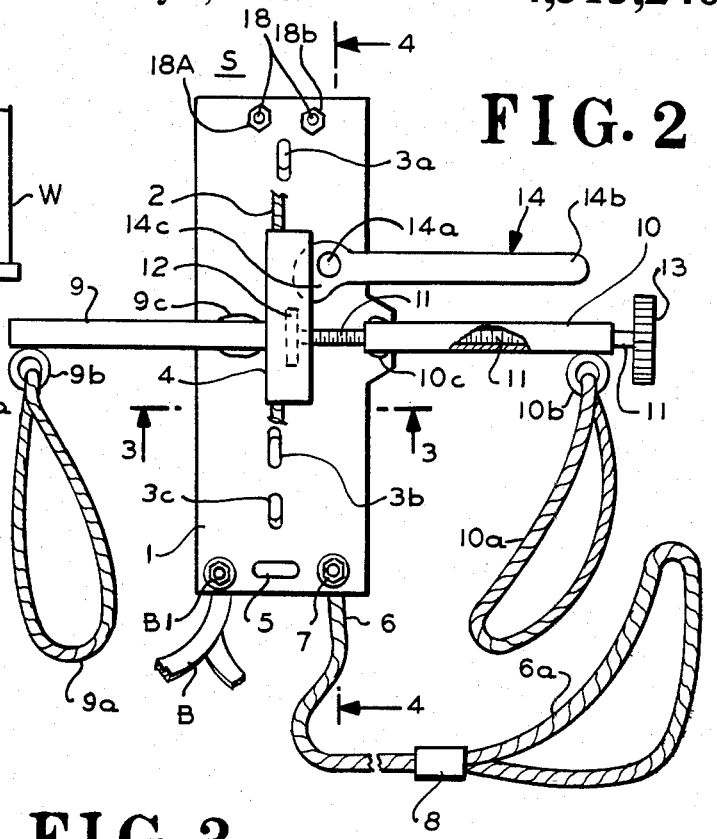
FIG. 2 is a front view of the device of FIG. 1.
Figure 3:
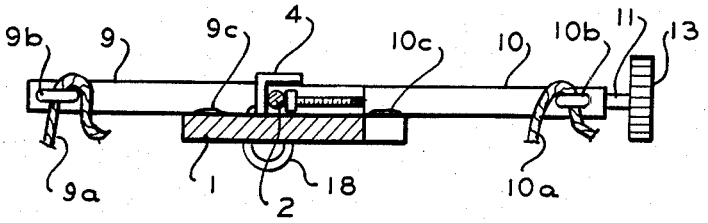
FIG. 3 is a cross-sectional view along lines 3—3 of FIG. 2.

Referring to FIGS. 2 and 3 they show safety device S in greater detail. Base 1 is, in the preferred embodiment, a rectangular metal plate on which are mounted lower arched guide 5 and an upper arched guide 18 on the forward and reverse side of base 1, respectively. In the preferred embodiment, arched guides 5 and 18 are "U"-shaped bolts mounted through apertures in base 1 and are fastened to the base by nuts. Arched guide 18 is shown fastened to base 1 by nuts 18*a* and 18*b*. As viewed herein, base 1 has bored through it slanting apertures 3*a* 3*b* and 3*c*, all three being sized to allow free passage of rope 2. Aperture 3*b* has on its front side an upwardly pointing mouth which slopes in a direction opposite to apertures 3*a* and 3*c*.

Handlebar 9 is welded at joint 9*c* to the left side of base S and handlebar 10 is welded at joint 10*c* to the right tab projecting from base 1. Threaded underneath the tips of handlebars 9 and 10, are eyebolts 9*b* and 10*b*, respectively. Previously illustrated wrist loops 9*a* and 10*a* are shown looped through eyebolts 9*b* and 10*b*, respectively.

A portion of rope 2 is shown laying within backstop 4, which is an angle iron having an outer branch parallel to base 1 and its other branch perpendicularally welded to base 1. Suspended from the lower right corner of base 1 is. It is a rope connected to the reverse side of base 1 by eyebolt 7. Eyebolt 7 is described in greater detail hereinafter. The outer end of stirrup 6 is formed into a loop 6*a* and then fastened with ferrule 8. Also secured to the underside of base 1 from its lower left corner is previously illustrated belt B. Belt B is looped through eyebolt B1, which is identical to eyebolt 7.

Handlebar 9 is a metal rod in this embodiment, which is welded, or otherwise secured, to base 1. It serves as a left grip for safety device S. Handlebar 10 is an internally threaded, hollow metal rod which is also secured transversely to base 1, and serves as a right grip for safety device S. Contained within the threaded bore of handlebar 10 is a manually operable means, threaded rod 11. The inner end of rod 11 rotatably supports anvil 12. In this embodiment, anvil 12 is a rectangular metal block located parallel to and underneath the upper branch of backstop 4. Affixed to the outside end of rod 11 is knurled knob 13, which is used to turn rod 10 and laterally move anvil 12.

Mounted on device S, parallel to and over handlebar 10, is another manually operable means, rotatable handle 14. Handle 14 may be squeezed toward handlebar 10 to finely adjust descent rate in a manner described hereinafter. Handle 14 is made from flat metal stock cut to the illustrated form and rotatably mounted on base 1 by rivet 14*a* to project transversely to said base. Handle 14 has an outer gripping end 14*b* and, at the opposite, inside end, camming end 14*c*. Camming end 14*c* can be rotated to adjustably thrust rope 2 against backstop 4.

Figure 4:
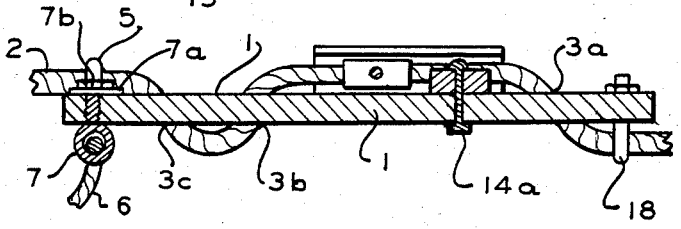
FIG. 4 is a longitudinal cross-section along lines 4—4 of FIG. 2.

Referring to FIG. 4, a longitudinal cross-section, rope 2 is shown installed in base 1. Rope 2 enters the safety device through arched guide 18 (a U-bolt) on the reverse side of base 1 and passes up through said base by way of aperture 3*a*. Rope 2 is then threaded along base 1 under the overhang of backstop 4. Rope 2 next passes down through base 1 by way of aperture 3*b*, then travels along the reverse side of base 1 and returns by way of aperture 3*c*. Rope 2 exits the safety device through arched guide 5.

Eyebolt 7 is secured to base 1 in the preferred embodiment by washer 7*a* and nut 7*b*. Eyebolt 7 anchors stirrup 6 to base 1. The inside end of stirrup 6 may be looped through eyebolt 7 and tied by knotting or clamping with a ferrule (not shown) similar to the other ferrule on stirrup 6 (ferrule 8 of FIG. 2).

Figure 5:
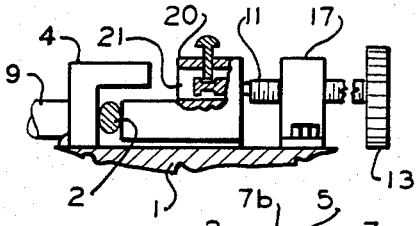
FIG. 5 is a detailed cross-section of the backstop and anvil mechanism which is an alternate to that of FIG. 2.

FIG. 5 is a detailed cross-section of backstop 4, but with an alternate anvil mechanism. In this figure, components identical to those of the prior figures bear the same reference numeral. Rod 11 is threaded through bearing collar 17 to enter bore 21 in anvil 20. Collar 17 is shown bolted to base 1. Thumbscrew 19 is threaded through the top of anvil 20 into bore 21 to fit into circumferential groove 22 at the inside end of threaded rod 11 thereby rotatbly attaching anvil 20 to threaded rod 11. Anvil 20 as shown, has an "L"-shaped cross-section, its lower branch sized to fit under backstop 4 to press rope 2 against the backstop. Backstop 4 has an "L"-shaped cross-section which is inverted with respect to that of said anvil.

Various modifications may be implemented in connection with the above-described preferred embodiment. For example, the base may be made of a suitably strong plastic instead of metal. Also, the rope could be fashioned of nylon, braided jute, plastic line, or a metal chain. The backstop may be shaped differently, depending upon the chosen shape of the anvil. The arched guides need not be "U"-shaped bolts, but could be integral cleats in some embodiments.

Obviously, many modifications and variations of the present invention are possible in light of the above teachings. It is, therefore, to be understood that, within the scope of the appended claims, the invention may be practiced otherwise than as specifically described.

What is claimed is:

1. An escape device for allowing controlled descent by an escapee down a rope comprising:

a base;

at least one transverse handlebar mounted on said base, said handlebar having a threaded bore;

manually operable means mounted on said base for adjustably gripping said rope, said manually operable means including means threadably mounted on said base for setting the extent of gripping of said rope, said manually operable means comprising a threaded rod screwed into said bore of said handlebar; and support means suspended from said base for supporting said escapee, said support means comprising a stirrup suspended from said base.

2. An escape device according to claim 1 wherein said handlebar includes:

a right and left colinear grip extending from said base.

3. An escape device according to claim 2, further including:

a backstop mounted on said base perpendicularly to said threaded rod, said rod being turnable to adjustably grip between it and said backstop said rope.

4. An escape device according to claim 3 wherein said manually operable means further comprises:

a handle rotatably mounted on said base, said handle having a camming end and a gripping end, said camming end being rotatable to adjustably thrust said rope against said backstop.

5. An escape device according to claim 4 wherein said base has at least one aperture for routing said rope through said base to said manually operable means.

6. An escape device according to claim 5 further comprising:

a pair of arched guides mounted on said base for guiding said rope through said manually operable means.

7. An escape device according to claim 6, further comprising:

an anvil rotatably mounted on the inside end of said threaded rod, said anvil having an "L"-shaped cross-section; and a knob affixed to the outside end of said rod for turning it, said backstop having an "L"-shaped cross-section which is inverted with respect to that of said anvil.

8. An escape device according to claim 1 wherein said manually operable means comprises:

a backstop mounted on said base perpendicularly to said handlebar;

a handle rotatably mounted on said base, said handle having a camming end and a gripping end, said camming end being rotatable to adjustably thrust said rope against said backstop.

* * * * *